United States Patent [19]

Rivera

[11] Patent Number: 4,932,680

[45] Date of Patent: Jun. 12, 1990

[54] BOOK CLIP

[75] Inventor: Jose L. G. Rivera, Rio Nasas, Mexico

[73] Assignee: Universal Network, Inc., Conroe, Tex.

[21] Appl. No.: 314,644

[22] Filed: Feb. 23, 1989

[51] Int. Cl.[5] ..... B42D 9/00

[52] U.S. Cl. ..... 281/42; 24/546

[58] Field of Search ..... 281/42; 24/546, 67.9

[56] References Cited

U.S. PATENT DOCUMENTS 1,196,715 8/1916 Noll ..... 281/42

*Primary Examiner*—Frank T. Yost

*Assistant Examiner*—Eugenia A. Jones

*Attorney, Agent, or Firm*—Vaden, Eickenroht, Thompson & Boulware

[57] ABSTRACT

A book clip made from a single piece of wire and having two rear legs that protrude downwardly to be inserted behind several pages respectively on the left and right side behind open, facing pages of a book being read and a front horizontal or transverse piece pinched rearwardly by an arch piece attached to the rear legs and to the front transverse piece to keep the top of the pages open while causing the bottom of the book to flare open to form a base for providing for the book to stand upright by itself.

1 Claim, 1 Drawing Sheet

FIG. 1
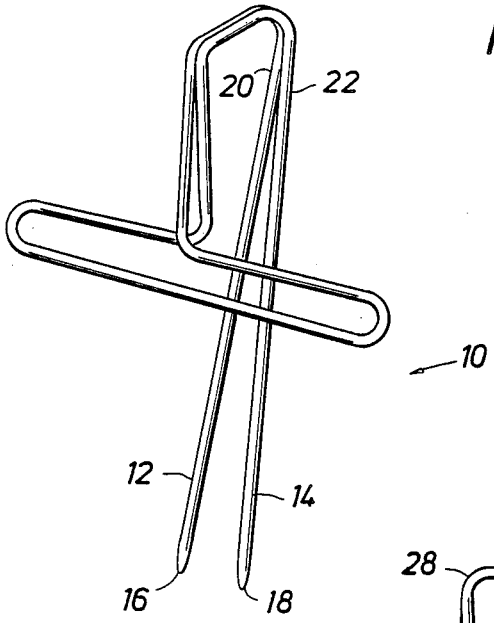
FIG. 2
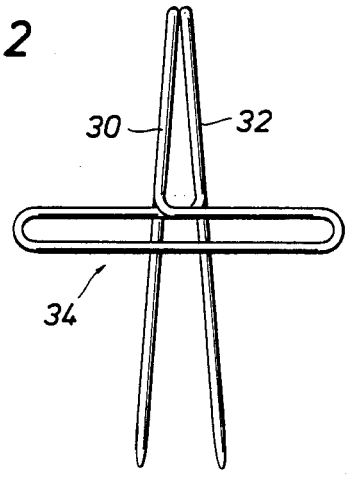
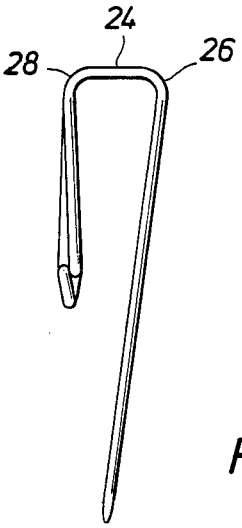
FIG. 3
FIG. 4
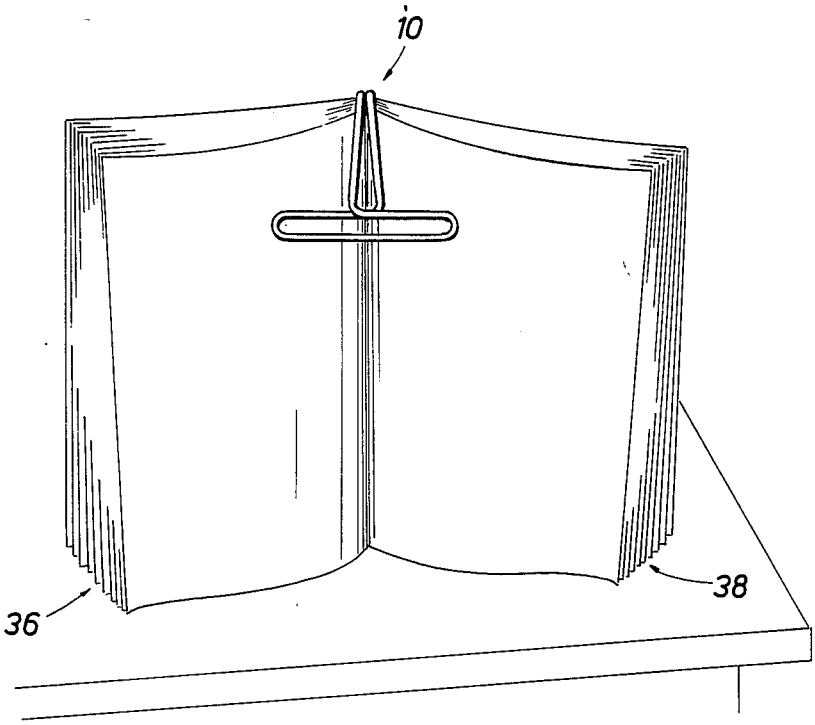

BOOK CLIP

BACKGROUND OF THE INVENTION

1. Field of the Invention

This invention pertains to a device for supporting a book open at a desired page and more specifically for holding a book open and enabling the book to be self-supporting in a stand-up position without requiring a support stand or the like.

2. Description of the Prior Art

It is well-known that books are easier to read and cause less physical strain to read over an extended period of time when they are supported, such as on a reading stand. This is because generally the words and pictures appearing on a page being read are all about the same distance from the eye. When a book is laid flat on a table or desk, the top of the page is further from the reader than the bottom of the page, requiring constant refocusing as the reader reads down the page. Furthermore, the letters are at an angle, rather than being normal to the line of sight. If one were to try to place a flatly laid, open book normal to the line of sight, one would have to hover over the book, thereby putting the person's back in a bit of a strain because of the strange posture.

Because stands are bulky and somewhat expensive, not too many people use them at their desks and reading tables in spite of the drawbacks referred to above.

So-called book clips to assist people in holding pages open to the desired pages have been invented over the years, as will be discussed below, but none has ever achieved a wide degree of acceptance. For example, as early as Dec. 19, 1876, U.S. Pat. No. 185,606, Weston, disclosed a book clip to separate the pages using a structure with a wide back and two legs in front. The structure was relatively large, tended to slide on the page and was not sturdy. U.S. Pat. No. 294,087, Small, disclosed a bent structure forming a clamp for holding a book open and clamping it to a stand. U.S. Pat. No. 395,473, Bartley, discloses a wire structure somewhat like the Weston structure, but having a total of four depending supports, the middle two somewhat close together to keep the clip from sliding sideways quite so far as the Weston clip. U.S. Pat. No. 397,890, Beirdler, discloses several bent configurations that wrap around the book for holding it open from the back. U.S. Pat. No. 560,025, Ellis, reveals several structures a little like Bartley with the two middle legs longer than the outside legs and joined at the top with a resilient spring to permit use on rather large books.

U.S. Pat. No. 965,720, Limpus, discloses two spaced apart arc clamps on a bar, that appears particularly suited for holding sheet music, rather than a conventional book. U.S. Pat. No. 1,762,686, Hayashi, discloses a bar and clamp arrangement that appears to clamp the pages remote from the center of the book and is adjustable to hold different page thicknesses. U.S. Pat. No. 4,015,813, Graham, discloses a bookholder with a large wire stand position fitting behind the book, a center U-shaped, double-leg that fits at the spine and spring-loaded outer legs for holding pages at a distance remote from the spine. U.S. Design Pat. No. D269,443, Million, discloses a three-leg stand and bookholder for sitting on a desk, supporting the center of the book and the two facing pages at distances remote from the center.

It appears that for quite some time, there has been a need for a small, simple, and inexpensive structure for holding a book open and even in providing a stand or support for a book while keeping it open so that it can be viewed standing vertical or nearly so. As shown above, devices have been proposed for book clips that were made wholly or partially from wire stock. However, all known prior art devices are either fairly large and appear to be either cumbersome to use or fragile and readily bent or misshapened in use. Many others are made up of numerous parts and appear to be rather expensive to make both from the point of view of cost of materials as well as in difficulty to manufacture economically.

Therefore, it is a feature of the present invention to provide an improved book clip that is small and rugged and that includes a small amount of material and is inexpensive to fabricate or manufacture.

It is another feature of the present invention to provide an improved book clip that is small and compact, yet not only keeps books of many sizes and construction open, but also causes the book with which it is used, to be self-supporting in a desirable, nearly vertical orientation.

SUMMARY OF THE INVENTION

A preferred embodiment of the book clip includes in a single bent wire configuration two rear legs, a looped elongate transverse front piece and a double-wire arch piece that connects the legs to the transverse front piece, the two wires crossing over at the loop piece to provide rigidity of structure. The arc described by the arch piece is more than 180°, so as to pinch the pages, not just hold them open. Thus, the bottom of the pages are caused to flare out and create a self-supporting base for holding the book in a vertical orientation.

BRIEF DESCRIPTION OF THE DRAWINGS

So that the manner in which the above-recited features, advantages and objects of the invention, as well as others which will become apparent, are attained and can be understood in detail, a more particular description of the invention briefly summarized above may be had by reference to the embodiment thereof which is illustrated in the appended drawings, which drawings form a part of this specification. It is to be noted, however, that the appended drawings illustrate only a preferred embodiment of the invention and are therefore not to be considered limiting of its scope, for the invention may admit to other equally effective embodiments.

In the Drawings:

FIG. 1 is a front oblique view of a preferred embodiment of a book clip in accordance with the present invention.

FIG. 2 is a front view of the book clip shown in FIG. 1.

FIG. 3 is a right side view of the book clip shown in FIG. 1.

FIG. 4 is a pictorial view of the book clip shown in FIG. 1 as it is used in a typical book in order to keep the book upright or vertical in a desirable reading orientation on a desk top.

DESCRIPTION OF THE PREFERRED EMBODIMENT

Now referring to the drawings and first to FIG. 1, a book clip 10 is shown in accordance with the preferred embodiment of the present invention. It will be noted that the book clip is made of a single piece of wire, somewhat heavier than a large paper clip. Such wire is normally made of spring steel and is about 1/32" or 0.8 millimeters in diameter.

The book clip contains a left leg 12 and a right leg 14 which are somewhat elongated and generally rounded at tips 16 and 18, respectively. The overall length of the clip is approximately 2½" or 6.35 centimeters.

The two legs are separated at their lower ends by about ¾" (1.9 cm) and merge or come together at their upper ends 20 and 22, respectively. The lower ends are gently pointed.

The top portion of the overall clip is a double-wire, squared arch piece 24, best shown in FIG. 3. The respective two wires of the arch piece are respectively connected at the upper ends 20 and 22 of legs 12 and 14, in a squared bend 26. The arch piece is squared off in front at a square bend 28 so that the overall arc described by the arch piece is slightly more than 180°. The front part of the arch piece continues in respective two-arm configurations slightly separating at approximately the same angle separation as legs 12 and 14, as best shown in FIG. 2. The front arms attached to the arch piece are identified by numerals 30 and 32, respectively.

Transverse front piece 34 describes an elongated loop configuration, the upper portion of the loop joining arm pieces 30 and 32. However, it will be seen that leg 30 shown on the left crosses over to join the top portion of transverse piece 34, thereby joining the top of the loop on the right. In like fashion, arm piece 32 crosses over to join the left portion of the top of the loop of piece 34 on the left. Such bend at the front portion of the clip makes for a very rugged structure. The arch piece describing more than a 180° arc makes a clip or pinch-like structure functioning in a fashion similarly to a common paper clip.

Now referring to FIG. 4, a typical book is shown standing upright on a table or desk with clip 10 shown in the position of use. The legs are inserted behind the first several pages of the open book so that legs 12 are inserted on the left and leg 14 is inserted behind the first several pages on the right. The legs are not usually behind the entire book, but merely inserted about 25 or so pages deep from the open or facing pages. The transverse portion of the clip presses the book open near the top. Typically this is about an inch (2.5 cm) or so from the top of the arch. This causes a flaring of the book at flare 36 and 38, respectively, thereby creating a base for the book to be self-supporting so as to hold the book in the vertical or upright position shown.

The clip may be used on very thin books which are either hardback or paperback. For example, even a very thick telephone directory may be held open in the manner shown. Conversely, even a very small, rather flimsy book may be held in like manner. In either event, the bottom of the book is flared in the manner shown in FIG. 4 on either side. Again, thick books may be held in such a fashion without springing the book clip at all since the legs of the clip are only inserted a few pages deep on either side and not behind the entire book.

In use, after a page is read, the clip is merely raised in position without removing the legs. The page is turned and the clip pressed back. After a few pages are read, the clip may be removed all-together and re-positioned so as to clip onto an approximately equal number of pages on either side. It will be seen that there is no complex structure that requires manipulation. Also, the clip retains itself in the middle of the book and does not slide from side-to-side.

Finally, the clip is sufficiently small that it may be put away easily in a desk drawer or even put in one's pocket in a very convenient manner.

Although the material that is anticipated for construction purposes is steel, resilient plastic extrusion of the same general shape may be employed, if desired. In any event, the shape is simple and does not use many different materials and can be readily extruded and shaped in the manner shown, which makes the book clip mass-producible in a very economic fashion. Also, the clip is rugged enough that it is not easily bent out of shape.

While a particular embodiment of the invention has been shown and discussed, it will be understood that the invention is not limited thereto, since many modifications may be made and will be apparent to those skilled in the art.

What is claimed is:

1. A book clip formed from a single piece of tubular material, comprising first and second elongate legs separated at their lower ends for respective insertion at the top of a book across the open center of the book and behind at least its left and right facing pages, an elongate piece approximately perpendicular to said first and second legs, said elongate piece angled toward said first and second legs, the left and right ends thereof pressing against the left and right facing pages, and an arch portion extending from the top of the legs to the center of said elongate piece, said arch portion including a first side and a second side, the top of said first leg joining said first side of said arch portion, which, in turn, is connected to one side of said elongate piece, and the top of said second leg joining said second side of said arch portion, which, in turn, is connected to the other side of said elongate piece, said first side of said arch piece crossing over to join the opposite side of said elongate piece from said first leg that it joins, and said second side of said arch piece crossing over to joint the opposite side of said elongate piece from said second leg that it joins.

* * * * *